United States Patent [19]

Hotta et al.

[11] 4,450,345

[45] May 22, 1984

[54] FOODSTUFFS HEATING APPARATUS WITH SELECTIVE HEATING FUNCTIONS

[75] Inventors: Kouichi Hotta, Yachiyo; Yukichi Yazawa, Kashiwa; Osami Tatsukawa, Matsudo, all of Japan

[73] Assignee: Hitachi Heating Appliances Co., Ltd., Chiba, Japan

[21] Appl. No.: 256,619

[22] Filed: Apr. 22, 1981

[30] Foreign Application Priority Data

May 12, 1980 [JP] Japan ..... 55-62494
May 12, 1980 [JP] Japan ..... 55-62495

[51] Int. Cl.[3] ..... H05B 1/02

[52] U.S. Cl. ..... 219/491; 219/493; 219/10.55 B; 200/46; 235/445; 235/447

[58] Field of Search ..... 219/10.55 B, 492, 493, 219/502, 497; 200/46; 235/435, 445, 444, 489, 447

[56] References Cited

U.S. PATENT DOCUMENTS 4,273,996 6/1981 Weimer .
4,297,568 10/1981 Okatsuka ..... 235/435
4,309,584 1/1982 Terakami ..... 219/10.55 B

FOREIGN PATENT DOCUMENTS 55-3560 1/1980 Japan ..... 219/10.55 B
55-38449 3/1980 Japan ..... 219/10.55 B
2026726 2/1980 United Kingdom ..... 219/10.55 B

*Primary Examiner*—M. H. Paschall
*Attorney, Agent, or Firm*—Antonelli, Terry & Wands

[57] ABSTRACT

In a foodstuffs heating apparatus wherein a plurality of different heating function modes are selectively effected and heating temperature and heating time are settable, when an oven heating function is selected from the plurality of function modes by a selected cooking card, the function of selector switches adapted to select heating function modes other than the oven heating function may be changed from the heating function mode selection to the heating temperature setting, so that the setting of heating temperature may automatically be effected by utilizing the cooking card.

10 Claims, 9 Drawing Figures

FOODSTUFFS HEATING APPARATUS WITH SELECTIVE HEATING FUNCTIONS

This invention relates to a foodstuffs heating apparatus and in particular to a foodstuffs heating apparatus wherein cooking cards are extensively utilized to set not only heating function but also heating temperatures which are relatively independent of preference of users and the type of foodstuffs to be cooked, thereby ensuring that the apparatus can skilfully manipulated without impairing the ease of its operation.

Inventors of this application have devoted themselves to research and development of foodstuffs heating apparatus which can selectively achieve various heating functions by utilizing cooking cards and have made a success. As will be detailed later, the heating function can automatically be selected by inserting a card and also can manually be selected without resort to the card. Of various modes of heating functions to be selected for cooking (to be described later with reference to Table 2), only an oven heating mode requires setting of the heating temperature. In other words, except for the oven heating mode, the heating function is automatically set by means of a cooking card and users are simply required to set heating time which has to be properly adjusted. Such convenience, however, often causes the users to miss the setting of heating temperature necessary for the oven heating mode. Further, in view of the fact that the heating temperature, like heating function, is definitely determined when the item of cooking to be effected is selected, it is desired to simplify the operation of the apparatus under this consideration.

This invention is achieved by taking all of the above considerations into account. An object of this invention is therefore to provide a foodstuffs heating apparatus which, upon selection of an oven heating mode by a cooking card, can set the heating temperature by means of the cooking card by changing the function of selector switches adapted to select the other heating function modes from the heating function mode selection to the heating temperature setting.

The invention will be described by way of preferred embodiments taken in conjunction with the accompanying drawings wherein.

For better understanding of the present invention as defined in the appended claims, a construction of a foodstuffs heating apparatus originally developed by the inventors on which the invention is based will first be described with reference to FIGS. 1 to 4.

Figure 1:
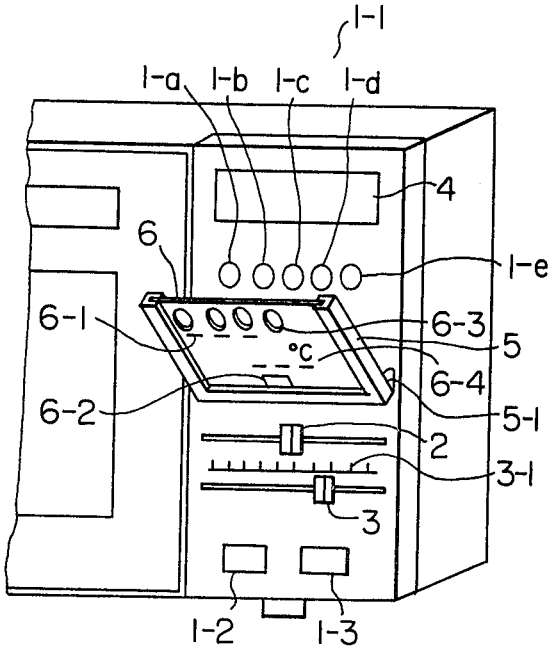
FIG. 1 is a fragmentary perspective view of a foodstuffs heating apparatus originally developed by the inventors on which the present invention is based, especially showing the process of location of a cooking card in a card holder.
Figure 2:
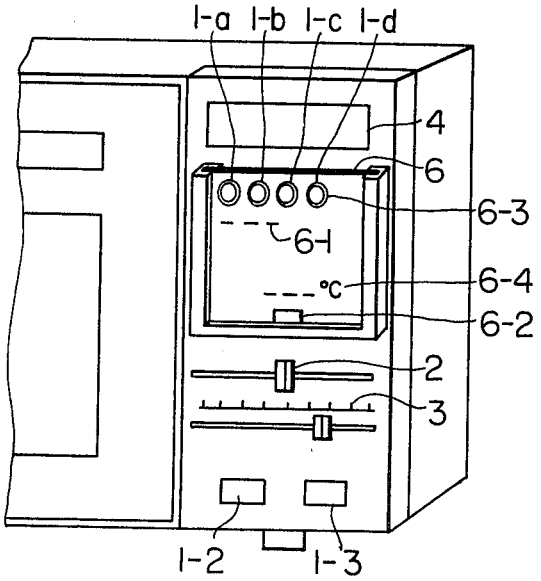
FIG. 2 is a similar view to FIG. 1, especially showing the card holder returned to a position for setting a desired heating function.
Figure 4:
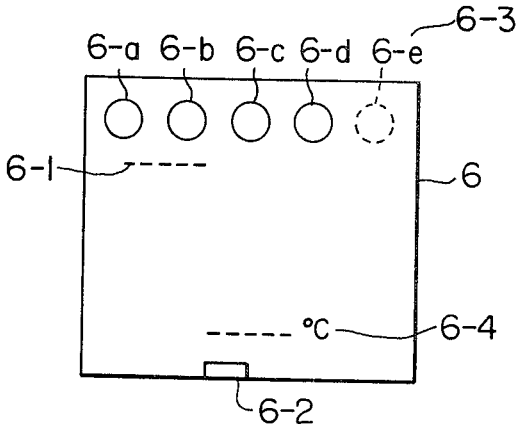
FIG. 4 is a front view of the cooking card.

To carry out heating with the foodstuffs heating apparatus, one desired cooking card, as designated by reference numeral 6, is first selected from a number of cooking cards prepared, by making reference to a name of cooking described on the card at 6-1. A card holder 5 hinged at a hinge 5-1 is then opened by pulling it out as shown in FIG. 1, and the cooking card 6 having a plurality of through holes 6-3 is located in the card holder 5. Subsequently, the card holder 5 is pushed toward an apparatus body which is provided with a set of heating function selecting switches 1-1 arranged in line and including a microwave strong heating mode selector switch **1-*a*, a microwave weak heating mode selector switch 1-*b*, a steam heating mode selector switch 1-*c*, a grill heating mode selector switch 1-*d*, and an oven heating mode selector switch 1-*e*, these mode selector switches being respectively in register with one of the through holes 6-3. Accordingly, when the cooking card 6 is put in place as shown in FIG. 2, specified selector switches corresponding to or associated with the through holes 6-3 can not be pushed by the card, whereas the remaining selector switch or switches faced to portions of the cooking card at which no through hole is formed are pushed by these portions of the card to thereby be actuated. Specifically, since a selected cooking card 6 as shown in FIG. 4 is formed with through holes 6-*a* to 6-*d* at portions corresponding to the selector switches 1-*a* to 1-*d* but a through hole is not formed at a portion, as designated by dotted line circle 6-*e*, corresponding to the selector switch 1-*e*, this cooking card causes only the oven heating mode selector switch 1-*e* to actuate. A set of such through holes 6-*a* to 6-*d* is represented by reference numeral 6-3**.

Figure 3:
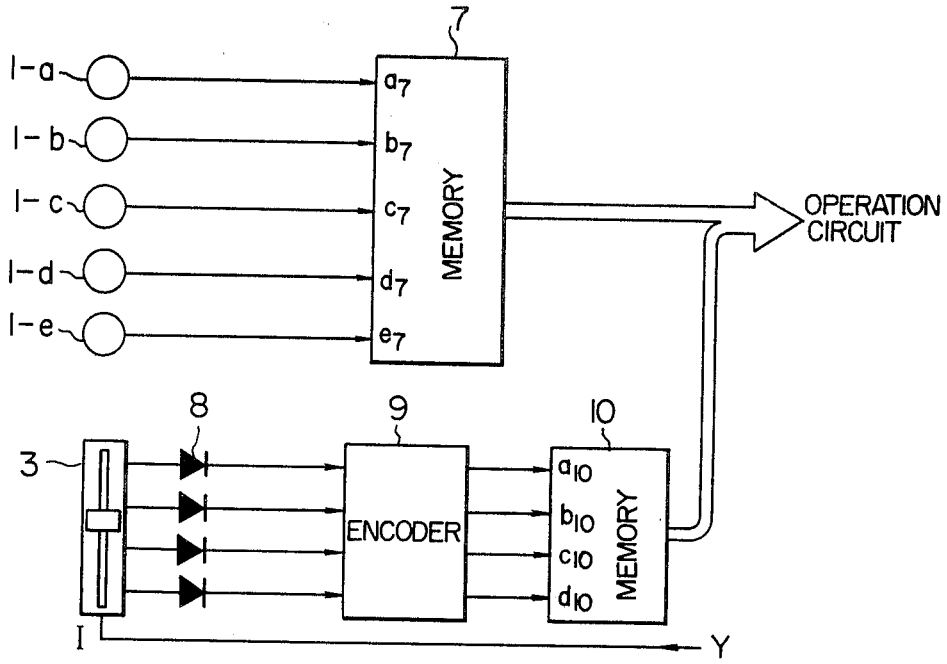
FIG. 3 is a block diagram of input circuits of heating function and heating temperature.

The oven heating mode is thus selected and a signal generated by the closure of the selector switch **1-*e* is applied to an input terminal $e_7$ of a function memory circuit 7 as shown in FIG. 3 which stores this function mode, causing an indicator 4** to indicate this selection with the display of, for example, "OVEN HEATING".

Below the card holder, there are provided knobs of digital value adjustors 2 and 3 adapted to set heating time and heating temperature, respectively. The position of the knob for heating time setting is indicated within a limited range of a mark 6-2 provided on the surface of the cooking card 6 as shown in FIG. 4. A card exclusively used for the oven heating mode as in this example is labelled with a heating temperature indication 6-4. The movement of the knobs is determined by making reference to these indications.

Assume now the mark 6-2 has its width indicating the range of heating time of 20 to 25 minutes, for instance. The knob of the adjustor 2 is then moved within this range and a time setting corresponding to the movement is successively and digitally indicated on the indicator 4. A suitable time of, for example, 22 minutes is selected in consideration of a material and water content of the stuffs and preference of the user while monitoring the indication, and the selected time, that is, the value of 22 minutes is stored in an internal memory circuit, of which details are not described herein. The heating temperature indication 6-4, on the other hand, is 180° C., for example, and the knob of the adjustor 3 is set to a position on a scale 3-1 corresponding to the indication of heating temperature. This value of heating temperature setting is converted in the adjustor 3 into a digital value of a Gray code by means of a pulse signal applied from a signal source Y to an input terminal I of the adjustor 3. The Gray code is then fed through a set of diodes 8 provided for preventing interference as shown in FIG. 3 to an encoder 9 for conversion into a binary code. Thus, the temperature setting is converted into a binary code as shown in Table 1 and stored in a heating temperature memory circuit 10. Specifically, the heating temperature set to 180° C. in this example is stored in the form of a code of 0101 as will be seen from Table 1. Input terminals $a_{10}$, $b_{10}$, $c_{10}$ and $d_{10}$ of the memory circuit 10 are connected to the encoder 9 to receive, for example, a fourth bit signal, a third bit signal, a second bit signal and a first bit signal, respectively, of the Table 1. The heating function, heating time and heating temperature thus stored are fed to an operation circuit (not shown) so that heating is carried out in accordance with these conditions, of which details are not described herein.

TABLE 1

| Heating Temperature Setting | Temp. Value in Binary Code | | | |
|---|---|---|---|---|
| | 4th bit | 3rd bit | 2nd bit | 1st bit |
| 140° C. | 0 | 0 | 0 | 1 |
| 150° C. | 0 | 0 | 1 | 0 |
| 160° C. | 0 | 0 | 1 | 1 |
| 170° C. | 0 | 1 | 0 | 0 |
| 180° C. | 0 | 1 | 0 | 1 |
| 190° C. | 0 | 1 | 1 | 0 |
| 200° C. | 0 | 1 | 1 | 1 |
| 210° C. | 1 | 0 | 0 | 0 |
| 220° C. | 1 | 0 | 0 | 1 |
| 230° C. | 1 | 0 | 1 | 0 |
| 240° C. | 1 | 0 | 1 | 1 |
| 250° C. | 1 | 1 | 0 | 0 |

Subsequently, a button of a heating start switch 1-3 is depressed and the interior of a heating chamber is preheated to 180° C. as preset in this example. After completion of the pre-heating, foodstuffs are placed in the heating chamber and the chamber continues to operate as a so-called oven, for heating the foodstuffs at 180° C. set temperature for set time of 22 minutes. If the setting is erroneously effected, the erroneous setting can be cancelled by depressing a button of a cancel switch 1-2. In the absence of a cooking card 6, the oven heating mode selector switch 1-*e* is manually depressed to effect the same setting.

With this foodstuffs heating apparatus, another heating function mode selector switch or a plurality of heating function mode selector switches in combination can be selected and depressed to selectively accomplish various heating functions. Tabulated in Table 2 are kinds of heating functions and switches to be operated.

TABLE 2

| Heating function modes | Cooking | Switches to be operated: Mode selector switch | Heating time SW | Heating temp. SW |
|---|---|---|---|---|
| Microwave heating with large output | Warming/high speed cooking with microwave energy | 1 - a | 2 | |
| Microwave heating with small output | Boiling/low speed cooking with microwave energy | 1 - b | 2 | |
| Steam heating | Steam cooking | 1 - c | 2 | |
| Grill heating | Grill cooking | 1 - d | 2 | |
| Oven heating | Oven cooking | 1 - e | 2 | 3 |
| Speed grill heating | Interior of foodstuffs is heated with microwave energy and surface thereof is then charred | 1 - a<br>1 - b | 2 | |
| Speed steam heating | Interior of foodstuffs is heated with microwave energy and then finished with dampness by steam | 1 - a<br>1 - c | 2 | |

It will be appreciated from Table 2 that amoung the various available heating function modes, only the oven heating mode requires the setting of heating temperature as has already been mentioned. Accordingly, except for the oven heating mode, the heating function is automatically set by the cooking card and the user is simply required to set the heating time which has to be properly adjusted. Such convenience, however, often causes the user to miss the setting of heating temperature necessary for the exceptional mode or oven heating mode as described heretobefore. In addition, since the heating temperature, like the heating function, is determined to a definite value such as 180° C. in this example when the name of cooking is settled, it is desired to simplify the operation of the apparatus under this consideration.

Figure 5:
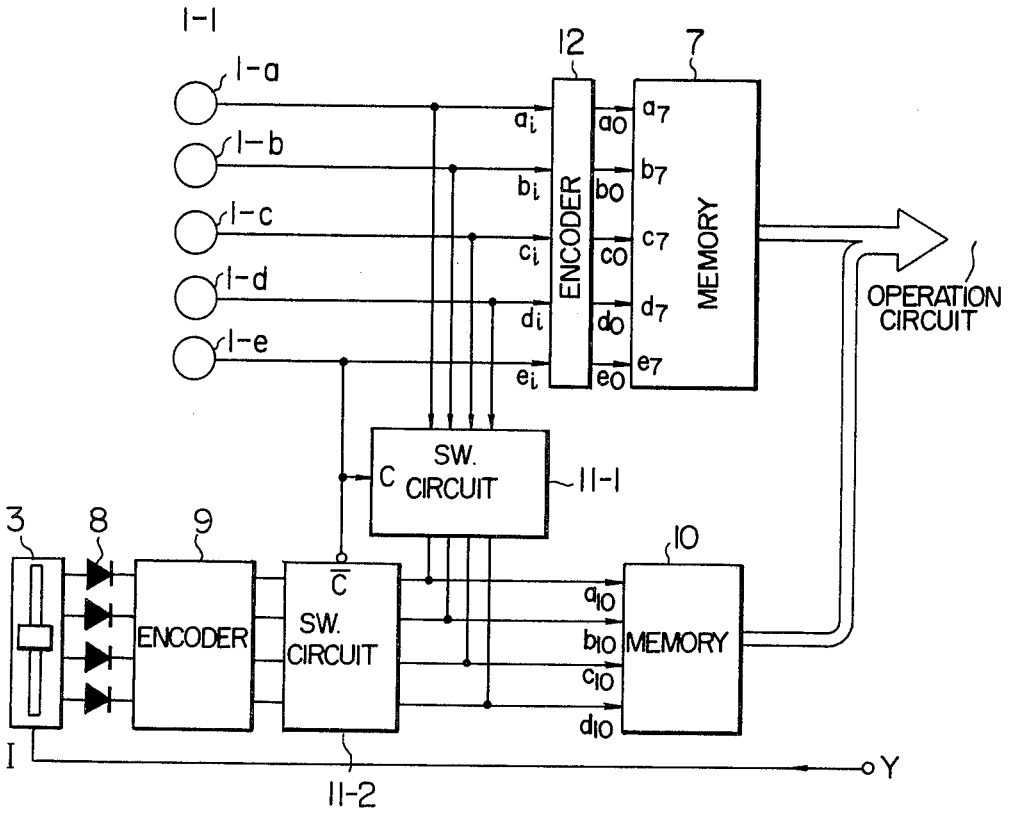
FIG. 5 is a block diagram of input circuits of heating function and heating temperature incorporated in an apparatus embodying the invention.
Figure 6:
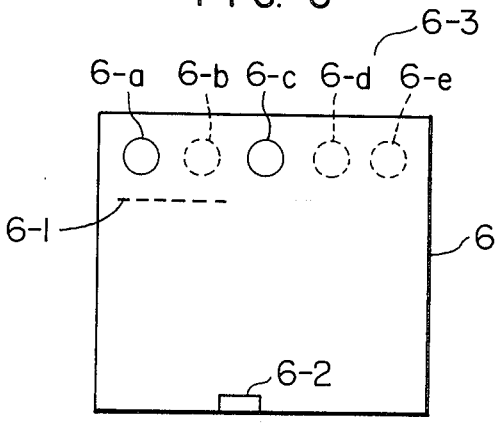
FIG. 6 is a front view of a cooking card used for the FIG. 5 apparatus.

Referring now to FIGS. 5 and 6, a preferred embodiment of the invention will be described. In these figures, like elements are designated by like reference numerals or characters as appearing in FIGS. 1 to 4 and will not be detailed.

In connection with a circuit for function selecting and setting operation incorporated in this embodiment, what is different from the apparatus shown in FIGS. 1 to 3 is the additional provision of electronic switch circuits 11-1 and 11-2 and an encoder 12 as shown in FIG. 5. Selector switches 1-*a* to 1-*e* are connected through the encoder 12 to input terminals $a_7$ to $e_7$ of a memory circuit 7, respectively. The encoder 12 has functions as listed in Table 3.

TABLE 3

| Input | | Output | |
|---|---|---|---|
| $a_i$ to $d_i$ | $e_i$ | $a_o$ to $d_o$ | $e_o$ |
| N | 1 | 0000 | 1 |
| N | 0 | N | 0 |

In Table 3 N denotes actual level of the respective signals as applied to input terminals $a_i$, $b_i$, $c_i$ and $d_i$ of the encoder 12, in other words actual level of the respective output signals from the selector switches 1-*a*, 1-*b*, 1-*c* and 1-*d*. More particularly, as will be seen from Table 3, when the level of the signal as applied to the input terminal $e_i$ of the encoder 12 is "1", each of output terminals $a_o$, $b_o$, $c_o$ and $d_o$ of the encoder 12 assumes "0"

level and an output terminal $e_o$ alone assumes "1" level, irrespective of the actual level of signals applied to the remaining input terminals $a_i$, $b_i$, $c_i$ and $d_i$. In contrast, when the level of the input signal received by the terminal $e_i$ is "0", only the output terminal $e_o$ assumes "0" level whereas the remaining output terminals $a_o$, $b_o$, $c_o$ and $d_o$ assume the same level as the input terminals $a_i$, $b_i$, $c_i$ and $d_i$.

The selector switches 1-*a*, 1-*b*, 1-*c* and 1-*d* are also connected through the first electronic switch circuit 11-1 having a control terminal (c) to input terminals $a_{10}$, $b_{10}$, $c_{10}$ and $d_{10}$ of a memory circuit 10, respectively.

The second electronic switch circuit 11-2 having a control terminal $(\overline{c})$ has its input terminals connected to output terminals of an adjustor 3 adapted to set heating temperature through a set of diodes 8 and an encoder 9. Output terminals of the second electronic switch circuit 11-2 are also connected to the input terminals $a_{10}$ to $d_{10}$ of the memory circuit 10.

Both the control terminal (c) of the first electronic switch circuit 11-1 and the control terminal $(\overline{c})$ of the second electronic switch circuit 11-2 are connected to the selector switch 1-*e*, so that the former (c) causes the associated first electronic switch circuit 11-1 to turn on in response to a "1" level control signal applied thereto from the switch 1-*e* so as to permit transmission of input signals of this electronic switch circuit 11-1 but causes the same first electronic switch circuit 11-1 to turn off upon the reception of a "0" level control signal applied thereto from the switch 1-*e* so as to inhibit transmission of the input signals. The latter control terminal $(\overline{c})$, on the other hand, causes the associated second electronic switch circuit 11-2 upon application of the "1" level control signal from the switch 1-*e*, for inhibition of the input signal transmission but permits the input signal transmission upon application of the "0" level control signal.

A cooking card 6 used in this embodiment may be selectively formed with through holes 6-*a* to 6-*e* opposing the selector switches 1-*a* to 1-*e* as described above. Specifically, in a cooking card as exemplified in FIG. 6, through holes 6-*a* and 6-*c* are selectively formed. It is to be noted that this cooking card 6 is not provided with such a heating temperature indication as designated at 6-4 in FIG. 4.

With this construction, the apparatus of an embodiment of this invention operates as follows: Such a selected cooking card 6 as shown in FIG. 6 is located in an opened card holder 5 as described above. The card holder 5 is then closed. Thus, as described above, specified selector switches of the switch set 1-1, which oppose portions of the cooking card where no through hole set 6-3 is formed, are actuated. More particularly, with the cooking card as exemplified in FIG. 6 which has no through holes at dotted line circles 6-*b*, 6-*d* and 6-*e*, the selector switches 1-*b*, 1-*c* and 1-*e* are actuated. Consequently, the selector switch 1-*e* as shown in FIG. 5 issues a "1" level signal which is fed to the input terminal $e_i$ of the encoder 12. Thus, as will be seen from Table 3, the output terminals $a_o$ to $d_o$ of the encoder 12 assume "0" level irrespective of the corresponding input signals and the output terminal $e_o$ assumes the "1" level. These output signals are applied to the input terminals $a_7$ to $e_7$ of the memory circuit 7 and the oven heating function mode is stored in the memory circuit 7, providing an indication "OVEN HEATING" on an indicator 4.

The "1" level signal from the selector switch 1-*e* is also fed to the control terminals (c) and $(\overline{c})$ of the respective electronic switch circuits 11-1 and 11-2 to turn the switch circuit 11-1 on and turn the switch circuit 11-2 off. As a result, the selector switches 1-*a* to 1-*d* are disconnected from the memory circuit 7 by the encoder 12 and coupled to the input terminals $a_{10}$ to $d_{10}$ of the memory circuit 10 so as to store the heating temperature setting therein. Conversely, the output signal from the digital value adjustor 3 adapted to set the heating temperature is disconnected from the memory circuit 10. Accordingly, the "1" level signals from the selector switches 1-*b* and 1-*d* and the "0" level signals from the selector switches 1-*a* and 1-]c are applied in the form of a binary signal "0101" to the input terminals $a_{10}$ to $d_{10}$ of the memory circuit 10. Since this binary signal corresponds to 180° C. as will be seen from Table 1, it is possible to set a value of heating temperature of 180° C. by means of the selector switches 1-*a* to 1-*d*.

In this manner, not only the oven heating mode can be selected but also the heating temperature necessary therefor can be set by utilizing one and the same cooking card. The user is then simply required to select a suitable heating time by adjusting the knob of the adjustor 2 within a range of the mark 6-2 provided on the cooking card.

The other types of the cooking card used for the other heating function modes which do not require the setting of heating temperature have the through hole 6-*e* in association with the selector switch 1-*e*. Consequently, with these cooking cards, the selector switch 1-*e* is disabled and the input terminal $e_i$ of the encoder 12 assumes the "0" level. All the output terminals $a_o$ to $e_o$ of the encoder 12 issue output signals which correspond to the input signals, resulting in equivalent omission of the encoder 12, and the first electronic switch circuit 11-1 is turned off and the second electronic switch circuit 11-2 is turned on, thereby establishing a connection which is equivalent to that shown in FIG. 3. For the setting of a different temperature, a different combination of the through holes 6-*a* to 6-*d* may be formed in the cooking card. The adjustor 3 for setting the heating temperature additionally provided for the heating apparatus of this embodiment assists in the manual setting of heating temperature without resort to the cooking card.

Figure 7:
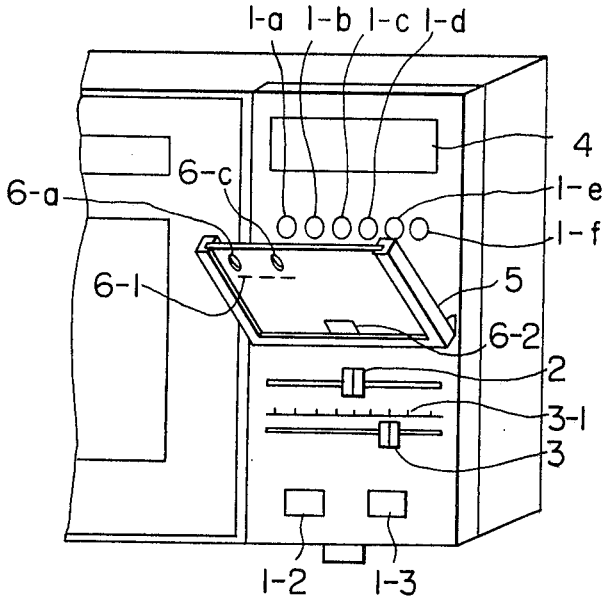
FIG. 7 is a fragmentary perspective view of a modified foodstuffs heating apparatus of the invention, especially showing the process of location of a cooking card in a card holder.
Figure 9:
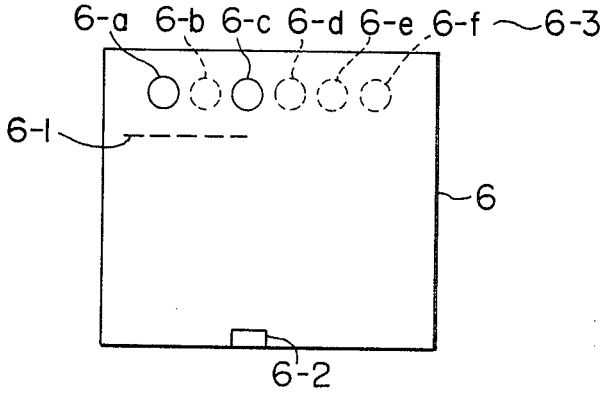
FIG. 9 is a front view of a cooking card used for the FIG. 7 modification.
Figure 8:
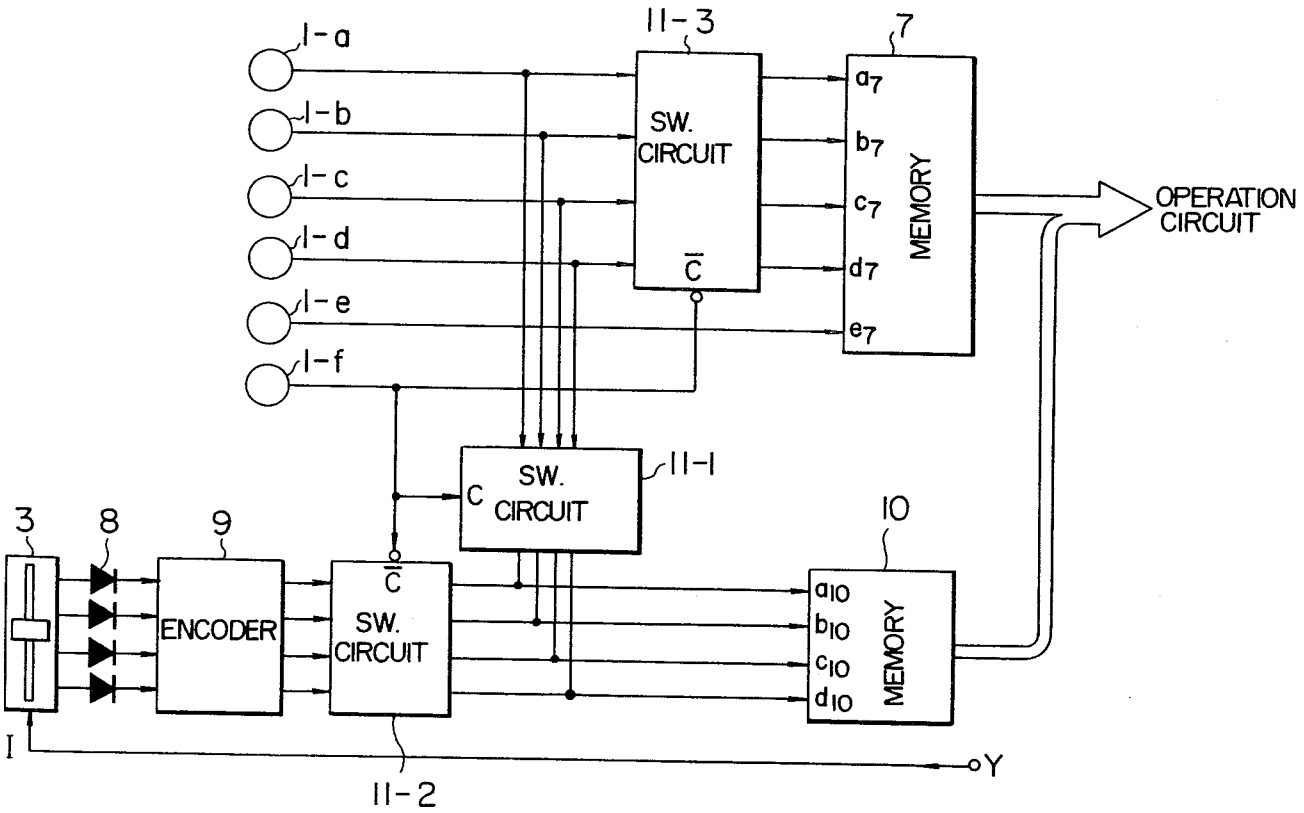
FIG. 8 is a block diagram of input circuits of heating function and heating temperature incorporated in the FIG. 7 apparatus.

Referring to FIGS. 7 to 9, another preferred embodiment of the invention will be described. In these figures, the same elements as and similar element to those described heretobefore are designated by the same reference numeral or characters and will not be detailed herein.

This embodiment is different from the foregoing embodiment in that the encoder 12 (FIG. 5) is replaced by a third electronic switch circuit 11-3 having a control terminal $(\overline{c})$ and a set of selector switches 1-1 includes an additional selector switch 1-*f*. The selector switch 1-*f* generates, as will be described later, a control signal which causes selector switches 1-*a* to 1-*d* originally designed to select the heating function modes to act to set the heating temperature. A cooking card 6 used in this embodiment may be selectively formed with through holes 6-*a* to 6-*f* opposing the selector switches 1-*a* to 1-*f*. Specifically, in a cooking card 6 as exemplified in FIG. 9, through holes 6-*a* and 6-*c* are selectively formed. Needless to say, this cooking card 6 is not provided with a heating temperature indication as designated at 6-4 in FIG. 4.

Among the set of selector switches 1-1, the selector switch 1-*e* is directly coupled to an input terminal $e_7$ of a memory circuit 7 and the selector switches 1-*a* to 1-*d* are coupled, through the third electronic switch circuit 11-3 having the control terminal $(\overline{c})$ to input terminals $a_7$, $b_7$, $c_7$ and $d_7$ of the memory circuit 7, respectively. The control terminal $(\overline{c})$ has the same function as the control terminal of the second electronic switch circuit 11-2 in the foregoing embodiment.

As will be seen from FIG. 8, in contrast to the foregoing embodiment wherein the selector switch 1-*e* is used for both the oven heating function mode selection and the control signal generation, the selector switch 1-*f* exclusively used for generating the control signal in this embodiment is connected to both the respective control terminals (c) and $(\overline{c})$ of first and second electronic switch circuits 11-1 and 11-2. The remaining connection in FIG. 8 is the same as that in FIG. 5 and will not be detailed herein.

With this construction, the apparatus of this embodiment operates as follows: A selected cooking card 6 having through holes 6-*a* and 6-*c*, for example as shown in FIG. 9, is located in an opened card holder 5 as shown in FIG. 7. The card holder 5 is then closed so that specified selector switches of the switch set 1-1, which oppose portions of the cooking card where no through hole set 6-3 is formed, are actuated. More particularly, with the cooking card as exemplified in FIG. 9 which has not any through holes to be formed at dotted line circles 6-*b*, 6-*d*, 6-*e* and 6-*f*, the selector switches 1-*b*, 1-*d*, 1-*e* and 1-*f* are actuated. Consequently, the selector switch 1-*e* as shown in FIG. 8 issues a "1" level signal which is fed to the input terminal $e_7$ of the memory circuit 7 so that the oven heating function mode is stored in the memory circuit 7, providing an indication "OVEN HEATING" on an indicator 4. The selector switch 1-*f* as shown in FIG. 8 also issues a "1" level signal which is fed to the control terminals of the electronic switches circuits 11-1, 11-2 and 11-3 so as to turn the switch circuits 11-2 and 11-3 off and turn the switch circuit 11-1 on.

As a result, the selector switches 1-*a* to 1-*d* are disconnected from the memory circuit 7 and respectively coupled to input terminals $a_{10}$ to $d_{10}$ of a memory circuit 10 adapted to store the heating temperature setting. The output signal from a digital value adjustor 3 adapted to set the heating temperature is also disconnected from the memory circuit 10. Accordingly, the "1" level signals from the selector switches 1-*b* and 1-*d* and the "0" level signals from the selector switches 1-*a* and 1-*c* are applied in the form of a binary signal "0101" to the input terminals $a_{10}$ to $d_{10}$ of the memory circuit 10. Since this binary signal corresponds to 180° C. as will be seen from Table 1, it is possible to set a value of heating temperature of 180° C. by means of the selector switches 1-*a* to 1-*d*. In this manner, the oven heating mode as well as the setting of 180° C. heating temperature can be settled by utilizing one and the same cooking card. The user is then simply required to select a suitable heating time by adjusting the knob of the adjustor 2 within a range of a mark provided on the cooking card.

For setting the other function modes which do not require the setting of heating temperature, the cooking card is formed with through holes 6-*e* and 6-*f* in association with the selector switches 1-*e* and 1-*f*. With this cooking card, the selector switches 1-*e* and 1-*f* are disabled and, in contrast to the above-mentioned embodiment, both the electronic switch circuits 11-2 and 11-3 are turned on and the electronic switch circuit 11-3 is turned off, thereby establishing a connection which is equivalent to that shown in FIG. 3.

For the setting of a different temperature, a different combination of the through holes 6-*a* to 6-*d* may be formed in the cooking card. The adjustor 3 for setting the heating temperature additionally provided for the heating apparatus of this embodiment assists in the manual setting of heating temperature without resort to the cooking card.

As has been described, the foodstuffs heating apparatus according to this embodiment is advantageous in that when the heating function mode which requires the setting of heating temperature, that is, the oven heating function mode is selected by utilizing a cooking card, the heating temperature setting can be effected simultanesouly with the setting of the oven heating function mode by means of one and the same cooking card by utilizing the selector switches origianlly designed to select the other heating function modes. Accordingly, in any of the heating function modes selected by the cooking card, the user is simply required to set the heating time which is adjustable and easiness of operation can be assured. Further, for any of the heating function modes, the cooking card may set all the unadjustable or fixed factors, thereby assuring compatibility between different heating function modes. Moreover, the function of the selector switches can be changed, thus reducing the number of additional selector switches.

What is claimed is:

1. A foodstuffs heating apparatus wherein a plurality of different heating function modes are selectively effected and heating temperature and heating time are settable, comprising:

a plurality of selector switches provided corresponding to said plurality of different heating function modes and each adapted to be actuated to select a corresponding one of the heating function modes, for causing said apparatus to operate in the selected heating function mode;

cooking cards prepared in one to one correspondence relationship with various different foodstuffs to be heated in said apparatus;

card holder means for removably holding a selected one of said cooking cards, in use;

through holes formed in each of said cooking cards at portions thereof so that when the selected cooking card is located in said card holder means, predetermined ones of said plurality of selector switches which are not required to be selectively actuated in connection with the object of cooking represented by the cooking card oppose said through holes so that said predetermined selector switches cannot be actuated by the selected cooking card, while the remaining one or more selector switches which are required to be selectively actuated do not oppose the through holes so that they are actuated by the selected cooking card;

means for generating a control signal when the foodstuffs represented by the selected cooking card requires the setting of heating temperature and a specified switch of said plurality of selector switches is actuated by the selected cooking card for at least one of selecting and operating a heating function mode requiring the setting of heating temperature; and selector switch function change means responsive to said control signal generated by said control signal generating means, for changing the function of preselected ones of said plurality of selector switches other than said specified switch from a purpose of heating function mode selection to another purpose of heating temperature setting so that said preselected ones of said plurality of selector switches thereby set a predetermined heating termperature.

2. The apparatus according to claim 1, wherein said specified switch generates, when actuated by the selected cooking card, a signal which is used not only as a selection signal for said specified heating function but also as said control signal.

3. The apparatus according to claim 1, wherein said control signal generating means comprises an additional switch provided separately from said plurality of selector switches, for generating said control signal when actuated, and wherein for the specified cooking cards directed to foodstuffs which do not require the setting of heating temperature, an additional through hole is formed at such a portion of each of said specified cooking cards that said additional through hole opposes said additional switch when a selected one of the specified cooking cards is located in said card holder means so as to prevent actuation of said additional switch, but for the remaining cooking cards directed foodstuffs which require the setting of heating temperature, no additional through hole is formed in each of said remaining cooking cards so that a selected one of said remaining cooking cards actuate said additional switch when located in said card holder means.

4. The apparatus according to claim 2 which comprises a first memory circuit for storing a selected heating function mode so that said apparatus carries out its heating operation in accordance with the stored function mode, and a second memory circuit for storing setting of heating temperature when set so that said apparatus carries out its heating operation in accordance with the stored heating temperature setting, said first memory circuit being connected through said selector switch function change means to all the plurality of selector switches, said second memory circuit being connected through said selector switch function change means to the remaining ones of said plurality of selector switches except for said specified selector switch.

5. The apparatus according to claim 4, wherein said selector switch function change means comprises encoder means and first controllable electronic switch means, said first memory circuit being connected through said encoder means to said plurality of selector switches, said encoder means permitting transmission therethrough of output signals from actuated ones of said plurality of selector switches when said specified selector switch is not actuated and, when said specified selector switch is actuated, permitting transmission therethrough of an output signal from said specified selector switch but inhibiting transmission therethrough of output signals from the remaining actuated selector switches, said second memory circuit being connected through said first controllable electronic switch means to the remaining ones of said plurality of selector switches except for said specified selector switch, said first controllable electronic switch means having a control terminal connected to said specified selector switch so that, when said specified selector switch is actuated, said first electronic switch means is turned on to permit transmission therethrough of all the input signals thereof but when said specified selector switch is not actuated, said first electronic switch means is turned off to inhibit transmission therethrough of all the input signals thereof.

6. The apparatus according to claim 3 which comprises a first memory circuit for storing a selected heating function mode so that said apparatus carries out its heating operation in accordance with the stored function mode, and a second memory circuit for storing setting of heating temperature when set so that said apparatus carries out its heating operation in accordance with the stored heating temperature setting, each of said first and second memory circuits being connected through said selector switch function change means to the remaining ones of said plurality of selector switches except for a specified one of said plurality of selector switches adapted to select a heating function mode which requires the setting of heating temperature, said specified selector switch being connected to said first memory circuit.

7. The apparatus according to claim 6, wherein said selector switch function change means comprises first and second electronic switch means each having a control terminal connected to said additional switch, said first and second memory circuits being connected respectively through said second and first electronic switch means to the remaining ones of said plurality of selector switches except for said specified selector switch, said first electronic switch means being connected to said additional switch so that when said additional switch is actuated, said first electronic switch means is turned on to permit transmission therethrough of all the input signals thereof and when said additional switch is not actuated, said first electronic switch means is turned off to inhibit transmission therethrough of all the input signals, said second electronic switch means being connected to said additional switch so that when said additional switch is actuated, said second electronic switch means is turned off to inhibit transmission therethrough of all the input signals thereof and when said additional switch is not actuated, said second electronic switch means is turned on to permit transmission therethrough of all the input signals thereof.

8. The apparatus according to claim 5 which comprises manual heating temperature setting means, and second controllable electronic switch means, said heating temperature setting means being connected through said second controllable electronic switch means to said second memory circuit, said second electronic switch means having a control terminal connected to said specified selector switch so that when said specified switch is actuated, said second electronic switch means is turned off to inhibit transmission therethrough of all the input signals thereof and when said specified switch is not actuated, said second electronic switch means is turned on to permit transmission therethrough of all the input signals thereof.

9. The apparatus according to claim 7 which comprises manual heating temperature setting means, and third controllable electronic switch means, said heating temperature setting means being connected through said third controllable electronic switch means to said second memory circuit, said third electronic switch means having a control terminal connected to said additional switch so that when said additional switch is actuated, said third electronic switch means is turned off to inhibit transmission therethrough of all the input signals thereof and when said additional switch is not actuated, said third electronic switch means is turned on to permit transmission therethrough of all the input signals thereof.

10. The apparatus according to claim 1, wherein the preselected ones of said plurality of selector switches include all of said plurality of selector switches other than said specified switch, and each of said preselected ones of said plurality of selector switches providing an output signal in accordance with the actuated and non-actuated condition thereof whereby the combination of output signals serves for setting the predetermined heating temperature.

* * * * *